US008538060B2

(12) United States Patent
Liu et al.

(10) Patent No.: US 8,538,060 B2
(45) Date of Patent: Sep. 17, 2013

(54) VOICE COIL LEAD WIRE AND LOUDSPEAKER USING THE SAME

(75) Inventors: Liang Liu, Beijing (CN); Jia-Ping Wang, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 141 days.

(21) Appl. No.: 12/824,376

(22) Filed: Jun. 28, 2010

(65) Prior Publication Data

US 2011/0033078 A1 Feb. 10, 2011

(30) Foreign Application Priority Data

Aug. 5, 2009 (CN) ..... 2009 1 0109566

(51) Int. Cl.
*H04R 1/02* (2006.01)

(52) U.S. Cl.
USPC ..... 381/386; 381/394; 381/396; 381/400; 381/409

(58) Field of Classification Search
None
See application file for complete search history.

(56) References Cited

U.S. PATENT DOCUMENTS

| | | | | |
|---|---|---|---|---|
| 4,312,118 | A | 1/1982 | Saik et al. | |
| 6,808,746 | B1 | 10/2004 | Dai et al. | |
| 7,050,601 | B2 * | 5/2006 | Suzuki et al. | 381/409 |
| 7,437,938 | B2 | 10/2008 | Chakraborty | |
| 7,848,538 | B2 * | 12/2010 | Ishigaki et al. | 381/410 |
| 8,331,605 | B2 * | 12/2012 | Liu et al. | 381/394 |
| 2004/0020681 | A1 | 2/2004 | Hjortstam et al. | |
| 2004/0053780 | A1 | 3/2004 | Jiang et al. | |
| 2004/0197006 | A1 * | 10/2004 | Suzuki et al. | 381/410 |
| 2006/0147081 | A1 | 7/2006 | Mango, III et al. | |
| 2006/0262956 | A1 * | 11/2006 | Ishigaki et al. | 381/410 |
| 2007/0166223 | A1 | 7/2007 | Jiang et al. | |
| 2008/0248235 | A1 | 10/2008 | Feng et al. | |
| 2008/0304694 | A1 | 12/2008 | Hayashi | |
| 2009/0013792 | A1 | 1/2009 | Qiao et al. | |
| 2009/0045005 | A1 | 2/2009 | Byon et al. | |
| 2009/0068448 | A1 | 3/2009 | Liu et al. | |
| 2009/0074228 | A1 | 3/2009 | Mango, III et al. | |
| 2009/0117434 | A1 | 5/2009 | Liu et al. | |
| 2009/0153502 | A1 | 6/2009 | Jiang et al. | |
| 2009/0155467 | A1 | 6/2009 | Wang et al. | |
| 2009/0160799 | A1 | 6/2009 | Jiang et al. | |

(Continued)

FOREIGN PATENT DOCUMENTS

| | | |
|---|---|---|
| CN | 2282253 | 5/1998 |
| CN | 1270488 | 10/2000 |

(Continued)

OTHER PUBLICATIONS

Xiao et al.,Flexible, Stretchable, Transparent Carbon Nanotube Thin Film Loudspeakers,Nanoletter, vol. 8; No. 12, 4539-4545.

*Primary Examiner* — Marlon Fletcher
(74) *Attorney, Agent, or Firm* — Altis Law Group, Inc.

(57) ABSTRACT

The present disclosure relates to a voice coil lead wire and a loudspeaker using the same. The voice coil lead wire includes a lead wire structure and a core wire structure. The lead wire structure includes at least one lead wire. The core wire structure includes at least one carbon nanotube wire structure. The carbon nanotube wire structure includes a plurality of carbon nanotubes. The at least one lead wire winds around the at least one carbon nanotube wire structure in a helix manner or a twisted manner.

20 Claims, 9 Drawing Sheets

(56) References Cited

U.S. PATENT DOCUMENTS

| | | | | |
|---|---|---|---|---|
| 2009/0169463 | A1* | 7/2009 | Smalley et al. | 423/445 B |
| 2009/0197082 | A1 | 8/2009 | Jiang et al. | |
| 2009/0220767 | A1 | 9/2009 | Schlogl et al. | |
| 2009/0272935 | A1 | 11/2009 | Hata et al. | |
| 2010/0150392 | A1* | 6/2010 | O'neill | 381/423 |
| 2011/0033078 | A1* | 2/2011 | Liu et al. | 381/400 |
| 2011/0086781 | A1* | 4/2011 | Smalley et al. | 506/32 |
| 2011/0299716 | A1* | 12/2011 | Reckert | 381/398 |

FOREIGN PATENT DOCUMENTS

| | | | |
|---|---|---|---|
| CN | 2488247 | | 4/2002 |
| CN | 1430785 | | 7/2003 |
| CN | 2583909 | | 10/2003 |
| CN | 2583909 | Y | 10/2003 |
| CN | 1568636 | A | 1/2005 |
| CN | 1640923 | | 7/2005 |
| CN | 1982209 | A | 6/2007 |
| CN | 101061750 | | 10/2007 |
| CN | 101061750 | A | 10/2007 |
| CN | 101239712 | | 8/2008 |
| CN | 101288336 | | 10/2008 |
| CN | 101288336 | A | 10/2008 |
| CN | 101304945 | | 11/2008 |
| CN | 101321410 | | 12/2008 |
| CN | 101381071 | | 3/2009 |
| CN | 101464759 | | 6/2009 |
| CN | 101464759 | A | 6/2009 |
| CN | 101497435 | A | 8/2009 |
| CN | 101499328 | | 8/2009 |
| JP | 60-27298 | | 2/1985 |
| JP | 63-49991 | | 12/1988 |
| JP | 7-138838 | | 5/1995 |
| JP | 2002-171593 | | 6/2002 |
| JP | 2002171593 | | 6/2002 |
| JP | 2002-542136 | | 12/2002 |
| JP | 2003-319490 | | 11/2003 |
| JP | 2003319490 | | 11/2003 |
| JP | 2004-32425 | | 1/2004 |
| JP | 2004032425 | | 1/2004 |
| JP | 2004-107196 | | 4/2004 |
| JP | 2006-147801 | | 6/2006 |
| JP | 2006147801 | | 6/2006 |
| JP | 2007-182352 | | 7/2007 |
| JP | 2007-290908 | | 11/2007 |
| JP | 2009-144158 | | 7/2009 |
| JP | 2009-146420 | | 7/2009 |
| JP | 2009144158 | | 7/2009 |
| JP | 2009-184910 | | 8/2009 |
| TW | 200904742 | | 2/2009 |

* cited by examiner

VOICE COIL LEAD WIRE AND LOUDSPEAKER USING THE SAME

CROSS-REFERENCE TO RELATED APPLICATIONS

This application claims all benefits accruing under 35 U.S.C. §119 from China Patent Application No. 200910109566.7, filed on Aug. 5, 2009, in the China Intellectual Property Office, the contents of which are hereby incorporated by reference.

BACKGROUND

1. Technical Field

The present disclosure relates to coil lead wires and loudspeakers using the same.

2. Description of Related Art

A voice coil lead wire is one component of a loudspeaker. A voice coil and an external audio input device can be electrically connected by the coil lead wire.

Presently, the voice coil lead wire is formed by intertwisting a plurality of metal wires. However, the metal wires have poor strength. A bent voice coil lead wire can cause a fatigue fracture of the metal wires in the voice coil lead wire and make the loudspeaker inoperative. Thus, the lifespan of the loudspeaker is reduced.

What is needed, therefore, is to provide a voice coil lead wire resisting fatigue fracture, and a loudspeaker using the same.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
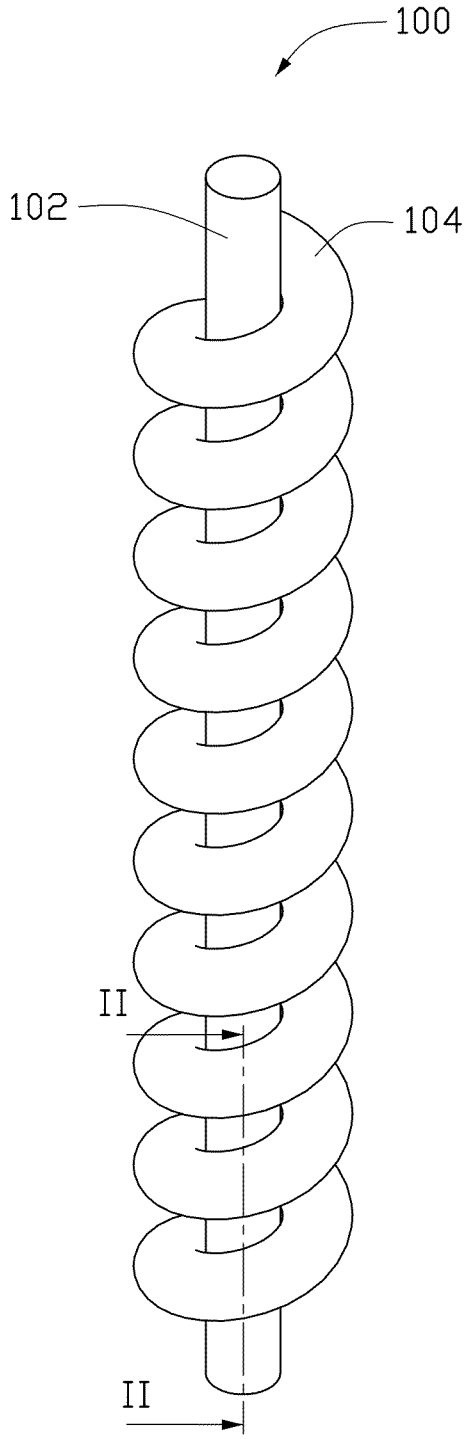
FIG. 1 is a structural schematic view of a first embodiment of a voice coil lead wire.
Figure 2:
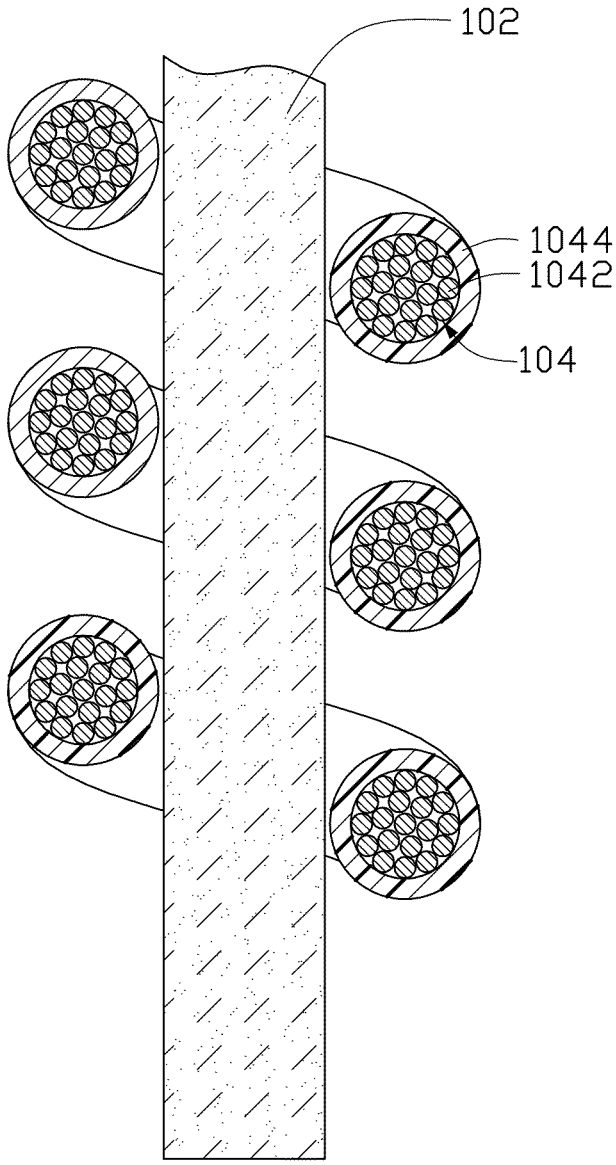
FIG. 2 is a sectional view of the voice coil lead wire of FIG. 1, taken along line II-II.

Referring to FIGS. 1 and 2, one embodiment of a voice coil lead wire 100 includes a core wire structure 102 and a lead wire structure 104. The lead wire structure 104 is wound around the axis of the core wire structure 102 in a helix manner.

The voice coil lead wire 100 can be fabricated by fixing the core wire structure 102 and winding the lead wire structure 104 on the surface of the core wire structure 102 in a helix manner around the axis of the core wire structure 102.

The lead wire structure 104 can be wound around the axis of the core wire structure 102 in a clockwise or anticlockwise direction. The axis direction of the lead wire structure 104 extends from one end of the core wire structure 102 to the other end thereof in a helix manner.

A plurality of helix portions, formed by winding the lead wire structure 104 into a plurality of windings around the core wire structure 102, are connected to each other. The helix angle of each helix portion are not limited. The number of the windings is related to the degree of the helix angle of every helix portion. The smaller the helix angle, the greater the number of the windings around the core wire structure 102, and the greater the weight of the lead wire structure 104. The helix angles of the plurality of helix portions can be the same or different. In one embodiment, the helix angles of the plurality of helix portions are the same and ranges from about 2 degrees to about 30 degrees. A diameter of the voice coil lead wire 100 can be substantially equal to a diameter of the core wire structure 102 plus twice of the diameter of the lead wire structure 104. In use, the voice coil lead wire 100 is connected to a voice coil of a speaker. The voice coil oscillates linearly such that the voice coil lead wire 100 is repeatedly deformed in response to the oscillation of the coil. The voice coil lead wire 100 applies a load to the voice coil. Thus, the weight of the voice coil lead wire 100 will influence the oscillation of the voice coil. The greater the weight of the voice coil lead wire 100, the greater the load of the voice coil. Therefore, if the voice coil lead wire 100 is too heavy, the voice coil cannot oscillate properly, thereby causing a distorted sound from the loudspeaker. Thus, the mechanical strength of the voice coil lead wire 100 should be high enough such that the voice coil lead wire 100 does not break easily and the diameter of the voice coil lead wire 100 is as small as possible. In one embodiment, the diameter of the voice coil lead wire 100 is in a range from about 0.1 millimeters (mm) to about 50 mm.

Figure 3:
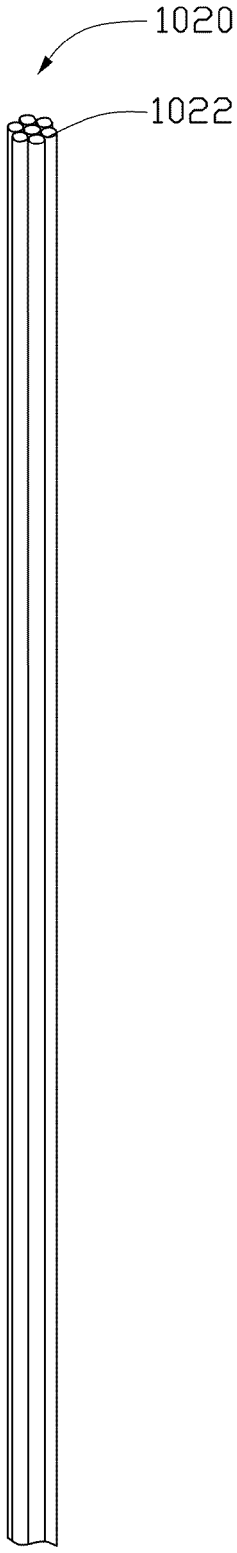
FIGS. 3 and 4 are a structural schematic view of a carbon nanotube wire structure in the voice coil lead wire of FIG. 1.
Figure 4:
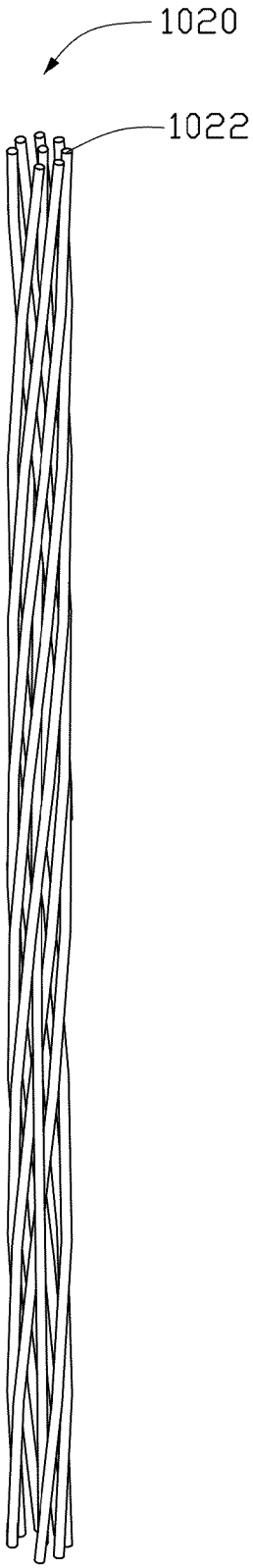

The core wire structure 102 includes at least one carbon nanotube wire structure. The carbon nanotube wire structure includes a plurality of carbon nanotubes. The carbon nanotubes can be single-walled, double-walled, or multi-walled carbon nanotubes. A diameter of each single-walled carbon nanotube can range from about 0.5 nanometer (nm) to about 10 nm. A diameter of each double-walled carbon nanotube can range from about 1 nm to about 15 nm. A diameter of each multi-walled carbon nanotube can range from about 1.5 nm to about 50 nm. The diameter of the carbon nanotube wire structure can be set as desired. Referring to FIGS. 3 and 4, the carbon nanotube wire structure 1020 includes at least one carbon nanotube wire 1022. The carbon nanotube wire structure 1020 can be a bundle structure composed of a plurality of carbon nanotube wires 1022 substantially parallel to each other, or the carbon nanotube wire structure 1020 can be a twisted structure composed of a plurality of carbon nanotube wires 1022 twisted together.

Figure 5:
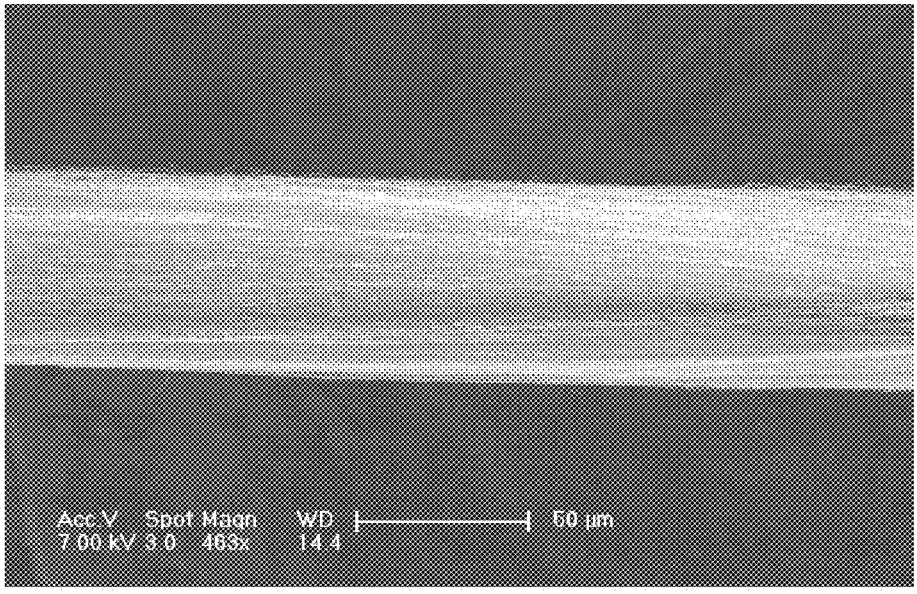
FIG. 5 is a Scanning Electron Microscope (SEM) image of a non-twisted carbon nanotube wire in the voice coil lead wire of FIG. 1.

The carbon nanotube wire 1022 can be a non-twisted carbon nanotube wire or a twisted carbon nanotube wire. Referring to FIG. 5, the non-twisted carbon nanotube wire includes a plurality of carbon nanotubes substantially oriented along a same direction (e.g., a direction along the length of the non-twisted carbon nanotube wire). The carbon nanotubes are substantially parallel to the axis of the non-twisted carbon nanotube wire. Specifically, the non-twisted carbon nanotube wire includes a plurality of carbon nanotubes joined end-to-end by van der Waals attractive force therebetween. A length of the non-twisted carbon nanotube wire can be arbitrarily set as desired. A diameter of the non-twisted carbon nanotube wire can range from about 0.5 nm to about 100 microns (μm). The non-twisted carbon nanotube wire can be formed by treating a drawn carbon nanotube film with an organic solvent. Specifically, the drawn carbon nanotube film is treated by applying the organic solvent to the drawn carbon nanotube film to soak the entire surface of the drawn carbon nanotube film. After being soaked by the organic solvent, the adjacent parallel carbon nanotubes in the drawn carbon nanotube film will bundle together, due to the surface tension of the volatile organic solvent as the organic solvent volatilizes, and thus, the drawn carbon nanotube film will be shrunk into a non-twisted carbon nanotube wire. The organic solvent can be ethanol, methanol, acetone, dichloroethane or chloroform. In one embodiment, the organic solvent is ethanol. The non-twisted carbon nanotube wire treated by the organic solvent has a smaller specific surface area and a lower viscosity than that of the drawn carbon nanotube film untreated by the organic solvent. An example of the non-twisted carbon nanotube wire is taught by US Patent Application Publication US 2007/0166223 to Jiang et al.

Figure 6:
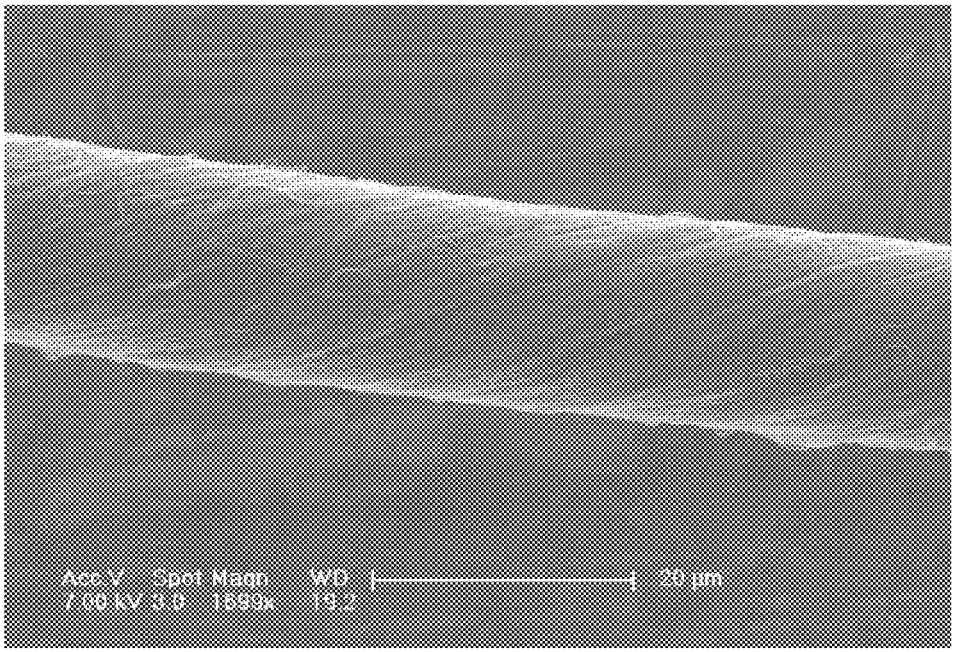
FIG. 6 is an SEM image of a twisted carbon nanotube wire in the voice coil lead wire of FIG. 1.

The twisted carbon nanotube wire can be formed by twisting a drawn carbon nanotube film by using a mechanical force to turn the two ends of the drawn carbon nanotube film in opposite directions. Referring to FIG. 6, the twisted carbon nanotube wire includes a plurality of carbon nanotubes oriented around an axial direction of the twisted carbon nanotube wire. The carbon nanotubes are aligned in a helix around the axis of the twisted carbon nanotube wire. More specifically, the twisted carbon nanotube wire includes a plurality of successive carbon nanotube segments joined end-to-end by van der Waals attractive force therebetween. Each carbon nanotube segment includes a plurality of carbon nanotubes substantially parallel to each other and combined by van der Waals attractive force. The carbon nanotube segment has arbitrary length, thickness, uniformity and shape. A length of the twisted carbon nanotube wire can be arbitrarily set as desired. A diameter of the twisted carbon nanotube wire can range from about 0.5 nm to about 100 μm. Further, the twisted carbon nanotube wire can be treated with a volatile organic solvent before or after being twisted. After being soaked by the organic solvent, the adjacent parallel carbon nanotubes in the twisted carbon nanotube wire will bundle together, due to the surface tension of the organic solvent as the organic solvent volatilizes. The specific surface area of the twisted carbon nanotube wire will decrease, and the density and strength of the twisted carbon nanotube wire will be increased.

A diameter of the carbon nanotube wire structure 1020 can be set as desired. In one embodiment, the diameter of the carbon nanotube wire structure 1020 ranges from about 50 μm to about 20 mm.

In addition, the core wire structure 102 can be a bundle structure composed of a plurality of carbon nanotube wire structures 1020 substantially parallel to each other. The core wire structure 102 can also be a twisted structure composed of a plurality of carbon nanotube wire structures 1020 twisted together.

Referring to FIG. 2, the lead wire structure 104 includes at least one lead wire 1042. The lead wire structure 104 can be a bundle structure composed of a plurality of lead wires 1042 substantially parallel to each other. The lead wire structure 104 can also be a twisted structure composed of a plurality of lead wires 1042 twisted together. The lead wire structure 104 can be made of a material having a small density and a high conductivity, such as copper (Cu), aluminum (Al), or any combination alloy thereof. In one embodiment, the lead wire structure 104 is a twisted copper structure wound on the surface of the core wire structure 102 in a helix manner.

Furthermore, an insulative layer 1044 can be wrapped around the surface of each lead wire 1042 or the surface of the lead wire structure 104. The insulative layer 1044 can be formed by coating an insulative lacquer on the surface of each lead wire 1042 or the surface of the lead wire structure 104. The insulative layer 1044 can be made of plastic or rubber. In one embodiment, the insulative layer 1044 is wrapped around the surface of the lead wire structure 104. The insulative layer 1044 can prevent the lead wire 1042 from corrosion due to exposure to moisture in the air, thereby prolonging the life of the voice coil lead wire 100.

The carbon nanotube wire structure 1020 can improve the strength and bend resistance of the voice coil lead wire 100, because the carbon nanotube wire structure 1020 is composed of a plurality of carbon nanotubes joined end-to-end by van der Waals attractive force therebetween, and therefore, has a high strength and bend resistance. In addition, the conductivity of the voice coil lead wire 100 is improved because the carbon nanotubes extend along the axis direction of the carbon nanotube wire structure 1020, and the carbon nanotubes have a good conductive property along the length of the carbon nanotubes. Furthermore, even when a fatigue fracture of the lead wires 1042 in the voice coil lead wire 100 has occurred, the carbon nanotube wire structure 1020 can still electrically conduct the audio electrical signals, thereby prolonging the lifetime of the loudspeaker.

Figure 7:
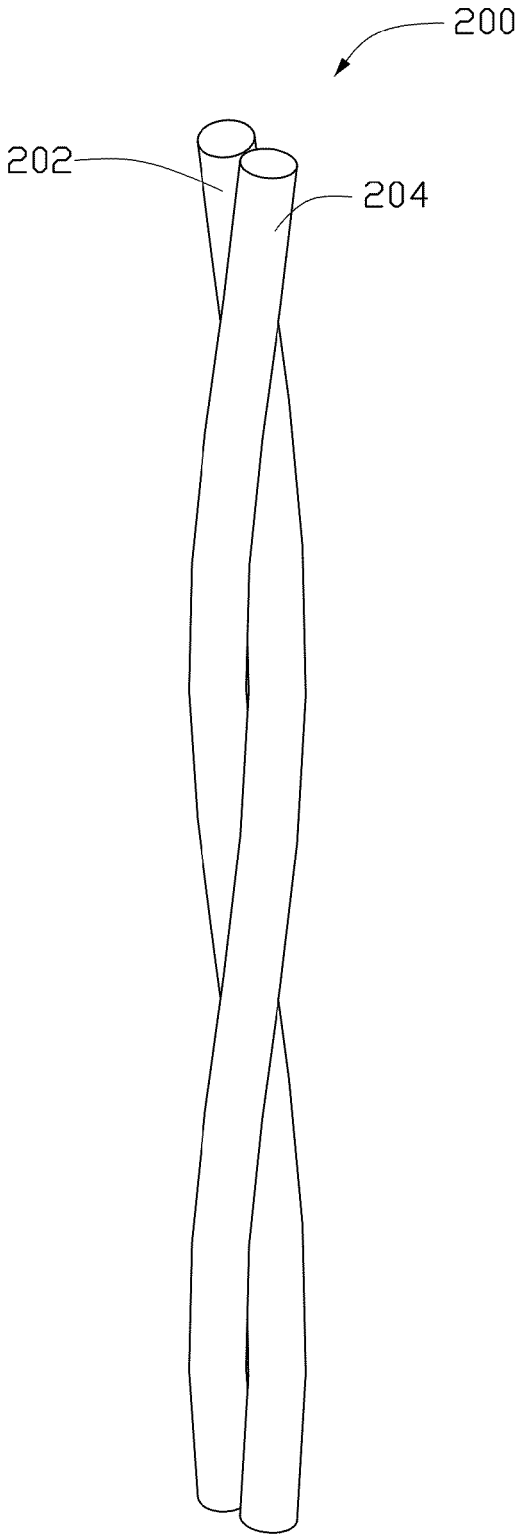
FIG. 7 is a structural schematic view of a second embodiment of a voice coil lead wire.

Referring to FIG. 7, a second embodiment of the voice coil lead wire 200 includes a core wire structure 202 and a lead wire structure 204 twisted with each other.

The voice coil lead wire 200 can be a twisted structure. The twisted voice coil lead wire 200 can be formed by disposing the core wire structure 202 and the lead wire structure 204 in a substantially parallel manner, and twisting the core wire structure 202 and the lead wire structure 204 by using a mechanical force to turn the opposite ends of the core wire structure 202 and the lead wire structure 204 in opposite directions. Thus, the core wire structure 202 and the lead wire structure 204 are twisted with each other.

The core wire structure 202 and the lead wire structure 204 extend from one end of the voice coil lead wire 100 to the other end of the voice coil lead wire 100, in a helix manner around the axis of the voice coil lead wire 200. Helix directions of the core wire structure 202 and the lead wire structure 204 are the same.

The helix angle of a plurality of helix portions, formed by twisting the lead wire structure 204 and core wire structure 202 into a plurality of laps, are not limited, and can be set as desired. The number of the windings is related to the helix angle of each helix portion. The smaller the helix angle, the greater the number of the windings of the core wire structure 202 and the lead wire structure 204, the greater the volume ratio of the lead wire structure 204 and core wire structure 202 per unit volume of the voice coil lead wire 200, and the greater the weight of the voice coil lead wire 200. In one embodiment, the helix angles range from about 2 degrees to about 30 degrees.

Figure 8:
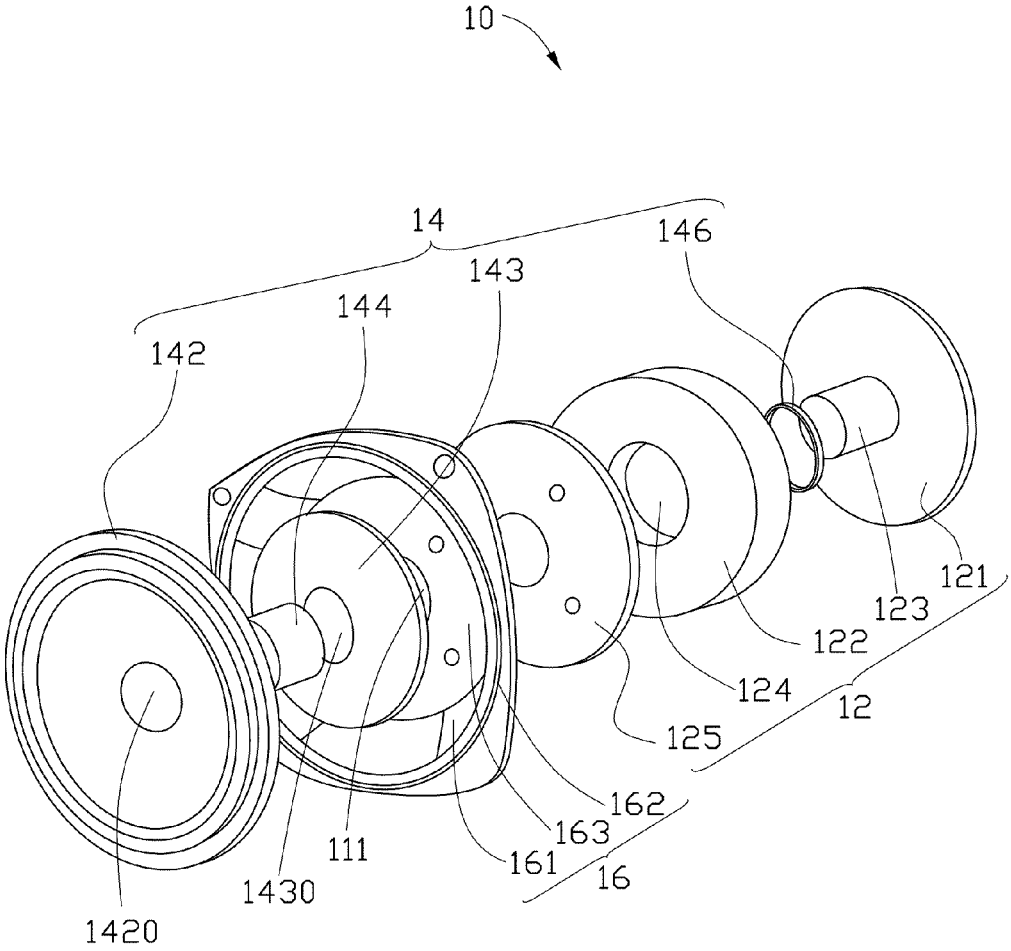
FIG. 8 is a structural schematic view of a loudspeaker using the voice coil lead wire.
Figure 9:
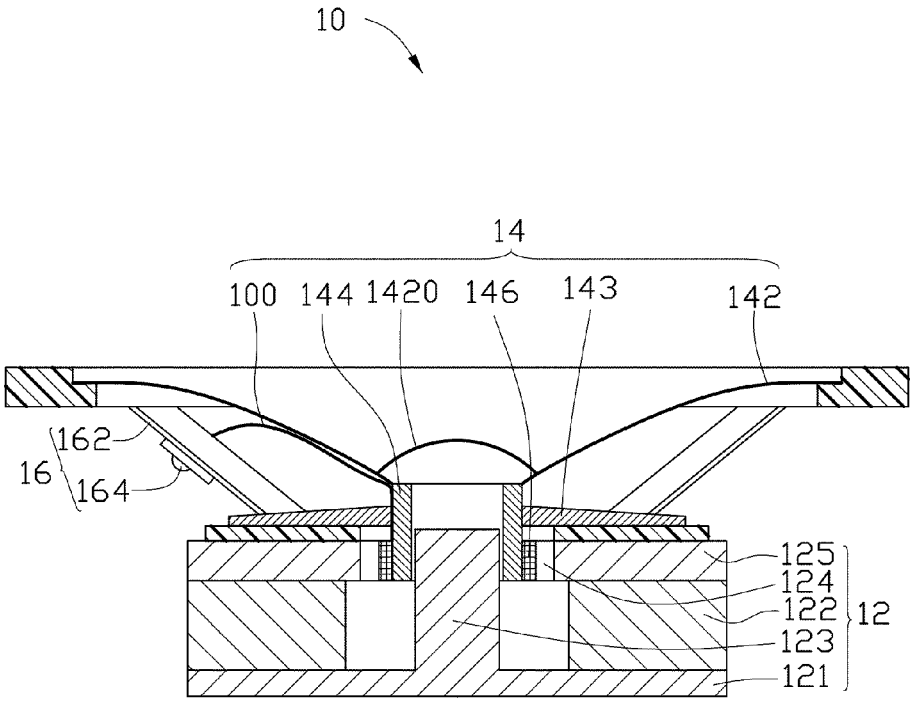
FIG. 9 is a sectional view of the loudspeaker of FIG. 8.

Referring to FIGS. 8 and 9, one embodiment of a loudspeaker 10 using the first or second embodiments of the voice coil lead wire 100, 200 includes a magnetic system 12, a vibrating system 14, and a supporting system 16.

The magnetic system 12 includes a back plate 121 having a center pole 123, a top plate 125, and a magnet 122. The back plate 121 and the top plate 125 are coaxial, and opposite to each other. The magnet 122 is fixed between the top plate 125 and the back plate 121. The top plate 125 and the magnet 122 are annular in shape. The top plate 125 and the magnet 122 cooperatively define a column space. The center pole 123 projects into the column space. The center pole 123, the magnet 122, and the top plate 125 are dimensioned and shaped to cooperatively define an annular magnetic gap 124.

The vibrating system 14 includes a diaphragm 142, a voice coil bobbin 144, a voice coil 146, a damper 143 defining a through hole 1430, and a voice coil lead wire 100. The diaphragm 142 has a funnel configuration and includes a dome 1420 protruding from a center of the bottom thereof. The bobbin 144 surrounds the center pole 123, and is disposed in the magnetic gap 124 to move along an axial direction of the center pole 123.

The bobbin 144 extends through the through hole 1430 to fix the diaphragm 142 and the damper 143 thereon. The voice coil 146 is received in the magnetic gap 124, and wound around the bobbin 144. The voice coil lead wire 100 includes a first end (not labeled) electrically connected to the voice coil 146 and a second end (not labeled) attached to the supporting system 16.

The supporting system 16 includes a frame 162 which is used to contain the vibrating system 14. The frame 162 can be frustum and may have a cavity 161 and a bottom 163 with an opening 111. The bobbin 144 extends through the opening 111, the top plate 125, and the magnet 122, and is received in the magnetic gap 124 such that the magnetic system 12, the vibrating system 14, and the supporting system 16 can be assembled together. The cavity 161 can receive the diaphragm 142 and the damper 143. The bottom 163 of the frame 162 is fixed to the top plate 125 of the magnetic system 12. The diaphragm 142 and the damper 143 are fixed to the frame 162. Additionally, a terminal 164 is disposed on the frame 162. The second end of the voice coil lead wire 100 can be directly connected to the terminal 164.

Furthermore, the voice coil lead wire 100 can be fixed to a surface of the diaphragm 142, and extend to the terminal 164. The voice coil lead wire 100 can be adhered to the surface of the diaphragm 142 by an adhesive, or fixed to the surface of the diaphragm 142 by a groove defined in the diaphragm 142. The second end of the voice coil lead wire 100 can be electrically connected to the terminal 164 by arbitrary means. For example, a short metal wire can be welded to a conductive portion of the terminal 164, and then adhered to the voice coil lead wire 100 by an adhesive. The voice coil lead wire 100 can also be directly and electrically connected to the terminal 164.

The voice coil lead wire 100, 200 include a carbon nanotube wire structure. The carbon nanotube wire structure can improve the strength and bend resistance of the voice coil lead wire 100, 200, because the carbon nanotube wire structure is composed of a plurality of carbon nanotubes joined end-to-end by van der Waals attractive force therebetween, which have a high strength and bend resistance. In addition, the conductivity of the voice coil lead wire 100, 200 is improved because the carbon nanotubes extend along the axis direction of the carbon nanotube wire structure, and the carbon nanotubes have a good conductive property along the length of the carbon nanotubes. Thus, the lifetime of the loudspeaker 10 can be prolonged.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A voice coil lead wire comprising:

a lead wire structure comprising at least one lead wire; and a core wire structure comprising at least one carbon nanotube wire structure;

wherein the at least one carbon nanotube wire structure comprises a plurality of carbon nanotubes joined end to end by van der Waals attractive force, and the at least one lead wire winds around the at least one carbon nanotube wire structure in a helix manner.

2. The voice coil lead wire as claimed in claim 1, wherein the at least one lead wire and the at least one carbon nanotube wire structure are twisted around each other.

3. The voice coil lead wire as claimed in claim 1, wherein the lead wire structure winds around an axis of the core wire structure.

4. The voice coil lead wire as claimed in claim 1, wherein the at least one carbon nanotube wire structure comprises at least one carbon nanotube wire.

5. The voice coil lead wire as claimed in claim 4, wherein the at least one carbon nanotube wire is a non-twisted carbon nanotube wire comprising a plurality of carbon nanotubes substantially parallel to each other and oriented along a length direction of the non-twisted carbon nanotube wire.

6. The voice coil lead wire as claimed in claim 4, wherein the at least one carbon nanotube wire is a twisted carbon nanotube wire comprising a plurality of carbon nanotubes aligned in a helix manner around an axis of the twisted carbon nanotube wire.

7. The voice coil lead wire as claimed in claim 4, wherein the at least one carbon nanotube wire structure is a bundle structure comprising a plurality of carbon nanotube wires substantially parallel to each other, or a twist structure comprising a plurality of carbon nanotube wires twisted together.

8. The voice coil lead wire as claimed in claim 1, wherein the plurality of carbon nanotubes is selected from the group consisting of single-walled carbon nanotubes, double-walled carbon nanotubes, and multi-walled carbon nanotubes.

9. The voice coil lead wire as claimed in claim 1, wherein the core wire structure is a bundle structure comprising a plurality of carbon nanotube wire structures parallel to each other, or a twisted structure comprising a plurality of carbon nanotube wire structures twisted together.

10. The voice coil lead wire as claimed in claim 1, wherein the lead wire structure is a bundle structure comprising a plurality of lead wires substantially parallel to each other, or a twisted structure comprising a plurality of lead wires twisted together.

11. The voice coil lead wire as claimed in claim 1, wherein an insulative layer wraps a surface of each of the at least one lead wire.

12. The voice coil lead wire as claimed in claim 1, wherein an insulative layer wraps a surface of the lead wire structure.

13. The voice coil lead wire as claimed in claim 1, wherein a diameter of the at least one carbon nanotube wire structure ranges from about 50 μm to about 20 mm.

14. A loudspeaker comprising:

a magnetic system defining a magnetic gap;

a vibrating system comprising:

a voice coil bobbin disposed in the magnetic gap;

a diaphragm fixed to the voice coil bobbin;

a voice coil wound around the voice coil bobbin; and a voice coil lead wire comprising a lead wire structure comprising at least one lead wire, and a core wire structure comprising at least one carbon nanotube wire structure, the at least one carbon nanotube wire structure comprising a plurality of carbon nanotubes joined end to end by van der Waals attractive force, the at least one lead wire winding around the at least one carbon nanotube wire structure in a helix manner, and the voice coil lead wire having a first end electrically connected to the voice coil and a second end; and a supporting system comprising a frame fixed to the magnetic system and receiving the vibrating system, the frame having a terminal electrically connected to the second end of the coil lead wire, and the diaphragm being received in the frame.

15. The loudspeaker as claimed in claim 14, wherein the at least one lead wire and the at least one carbon nanotube wire structure are twisted each other.

16. The loudspeaker as claimed in claim 14, wherein the lead wire structure winds around an axis of the core wire structure.

17. The loudspeaker as claimed in claim 14, wherein the at least one carbon nanotube wire structure comprises at least one carbon nanotube wire.

18. The loudspeaker as claimed in claim 14, wherein the at least one carbon nanotube wire structure is a bundle structure comprising a plurality of carbon nanotube wires substantially parallel to each other, or a twist structure comprising a plurality of carbon nanotube wires twisted together.

19. The loudspeaker as claimed in claim 18, wherein each carbon nanotube wire is a twisted carbon nanotube wire comprising the plurality of carbon nanotubes aligned in a helix manner around an axis of the twisted carbon nanotube wire.

20. The loudspeaker as claimed in claim 18, wherein each carbon nanotube wire is a non-twisted carbon nanotube wire comprising the plurality of carbon nanotubes substantially parallel to each other, oriented along a length direction of the non-twisted carbon nanotube wire.

* * * * *